United States Patent [19]

Mohn

[11] Patent Number: 5,060,737

[45] Date of Patent: Oct. 29, 1991

[54] DRILLING SYSTEM

[75] Inventor: Frank Mohn, London, England

[73] Assignee: Framo Developments (UK) Limited, London, England

[21] Appl. No.: 443,016

[22] Filed: Nov. 29, 1989

Related U.S. Application Data

[63] Continuation of Ser. No. 68,227, Jun. 30, 1987, abandoned.

[30] Foreign Application Priority Data

Jul. 1, 1986 [GB] United Kingdom ..... 8616006

[51] Int. Cl.[5] ..... E21B 4/04; E21B 17/00

[52] U.S. Cl. ..... 175/104; 174/47; 175/215; 175/320; 175/324; 439/194

[58] Field of Search ..... 175/320, 104, 105, 103, 175/215, 324; 166/65.1; 174/47; 439/191, 192, 194, 195

[56] References Cited

U.S. PATENT DOCUMENTS

| | | | |
|---|---|---|---|
| 1,927,664 | 9/1933 | Kareher | 175/320 X |
| 2,000,716 | 5/1935 | Polk | 175/320 X |
| 2,197,392 | 4/1940 | Hawthorn . | |
| 2,481,009 | 9/1949 | Gill . | |
| 2,637,527 | 5/1953 | Andrews, Jr. . | |
| 2,795,397 | 6/1957 | Hull et al. | 174/47 |
| 2,901,221 | 8/1959 | Whittle . | |
| 3,343,611 | 9/1967 | Jones, Jr. | 173/117 |
| 3,346,045 | 10/1967 | Knapp et al. . | |
| 3,888,319 | 6/1975 | Bourne, Jr. et al. | 175/76 |
| 4,287,444 | 9/1981 | Popov et al. | 310/13 |
| 4,314,615 | 2/1982 | Sodder, Jr. et al. | 175/94 |
| 4,436,168 | 3/1984 | Dismukes | 175/94 |
| 4,522,234 | 6/1985 | Kellner et al. | 439/194 X |
| 4,676,310 | 6/1987 | Scherbatskoy et al. | 166/55.1 |
| 4,683,944 | 8/1987 | Curlett | 166/65.1 |
| 4,690,212 | 9/1987 | Termohlen | 175/104 X |
| 4,722,402 | 2/1988 | Weldon | 175/104 |

FOREIGN PATENT DOCUMENTS

| | | |
|---|---|---|
| 0063444 | 4/1982 | European Pat. Off. . |
| 0110182 | 11/1983 | European Pat. Off. . |
| 1230382 | 12/1966 | Fed. Rep. of Germany . |
| 2441112 | 3/1976 | Fed. Rep. of Germany . |
| 2604063 | 8/1977 | Fed. Rep. of Germany . |

*Primary Examiner*—Hoang C. Dang

*Attorney, Agent, or Firm*—Young & Thompson

[57] ABSTRACT

A drilling system comprises a drill string (1) incorporating inbuilt tubular conductors (25), a mud supply passage, and passages for protective or other fluids. The drill string can be advanced by selectively actuable pistons (51,60) exposed to drilling mud flow, by electrically driven traction units (71,74) engaging the drill hole wall or by a linear electric motor element (82) co-operating with a drill hole casing (24), which can be moved thereby relative to the drill string. The drill bit (106) of the drill unit is driven rotatably by an electric motor (111,112) or reciprocably by a linear electric motor (125). The drill unit can be of two relatively slidable parts, with fluid pressure, which may be generated within the unit (189) axially loading the drill bit. Drilling forms can be resisted by clamps (129) clamping the unit and/or the drill string to the drill hole wall. The drilling direction can be adjusted by use of these clamps.

26 Claims, 7 Drawing Sheets

DRILLING SYSTEM

This application is a continuation of application Ser. No. 07/068,227, filed Jun. 30, 1987, now abandoned.

FIELD OF THE INVENTION

The invention relates to a drilling system, more specifically to a drilling system of the kind in which a drill string extends from topside or stationary equipment to a drill bit for performing a drilling operation.

BACKGROUND OF THE INVENTION

In known drilling systems of this kind, the drill bit may be driven by a motor receiving power by way of the drilling mud supplied to the drilling site, or by an electric motor. Difficulties are encountered with electric motor drive arrangements because of the length of the necessary cable connection, and the adverse environment in which the electric motor has to operate. Further problems arise in connection with directional or horizontal drilling, because information relating to performance of the drill bit and to its position has to be conveyed along the drill string more or less continuously. Mud pulsing can be employed in the mud drilling systems but the speed of data transmission is low, as is the volume of data that can be transmitted.

It is accordingly an object of the present invention to provide a drill string for a drilling system which facilitates transmission of electric power supply and/or communication signals therealong.

It is also an object of the invention to provide a drill string structure providing inbuilt electrical conductor means, in sections which can be handled by conventional pipe handling equipment.

It is also an object of the invention to provide a drill string structure having facilities therein for transmission of electric power and/or communication signals, for supply of drilling mud and for supply and/or return of protective or other fluid.

It is also an object of the invention to provide a drill string for use in a drilling system having selectively operable means for advancing the drill string along a drill hole in particular, a non-vertical drill hole.

It is also an object of the invention to provide a drill string which can be moved relative to a drill hole wall.

It is also an object of the invention to provide a drill system in which drilling reaction forces can be transferred to the drill hole wall.

It is also an object of the invention to provide a drill system incorporating remotely controllable local power generators at desired positions within the system.

It is also an object of the invention to provide a drill unit of which the drill bit can be selectively loaded in the drilling direction.

It is also an object of the invention to provide a drill unit of which the drilling direction can be selectively angled with respect to a drill hole axis.

SUMMARY OF THE INVENTION

The invention accordingly provides a drilling system of the kind described including a drill string incorporating as an integral part thereof electric conductor means capable of power and/or communication transmission. The conductor means can comprise rigid conductors in fixed relation to a drill pipe, the conductors being conveniently of concentric tubular configuration and mounted within the drill pipe, with clearance, and protective inner or outer tubing to provide at least one passage for fluid as well as for movement of drilling mud along the drill string.

The drill string can be made up of relatively short sections, the conductor means and any protective tubing within each section being then arranged for ready coupling with adjacent sections, with continuity of the electric conductor paths and fluid channels along the drill string.

The electric conductor arrangements for a drill string in accordance with the invention can provide mechanical protection for the conductors and can employ simple connections means, for example, screw-threaded or slip-on couplings The arrangements facilitate the use of an electric motor, which can be either rotary or linear, to drive the drill bit and they moreover provide for prompt transmission of a large volume of data between the fixed or topside control equipment, from which the drill string extends, and sensing and/or control equipment associated with the drill unit. The conditions under which the drill bit is operating, and the direction in which drilling is being carried out, are consequently easily monitored and appropriate control signals readily supplied to the drill unit. Directional control of the drill unit during horizontal or directional drilling is facilitated.

The conductor means also facilitate the provision of electrically powered and/or controlled auxiliary equipment at one or more positions along the drill string and also the use of sensor or measurement devices at such positions, as well as the location on the drill string of one or more local power sources or generators, and power and data and control communication between such sources and between them and the topside equipment.

The fluid passage or passages provided can be employed for circulation of oil or other protective fluid for one or more of such purposes as cooling, lubrication, insulation, operation of ancillary equipment, and supply of oil or chemicals required for drilling or for connected operations. The fluid can be held static under pressure or can be circulated at a selected pressure either with a special return path or it can be returned mixed with the returning drilling mud, as when the fluid is leaked through labyrinth seals employed for sealing moving parts of the system.

Although the drill string is primarily intended for systems in which the drill string is not required to rotate, its use in systems in which rotation is required is not precluded. The drill string can moreover be used as a standard drill string for parts of the drilling process, and can then be equipped with a standard drill bit, the conductor means being used for signalling, for example to control equipment from sensors at the drill unit monitoring the drilling process.

The invention also provides a drilling system of the kind described with means for selective movement of the drill string and/or production piping and/or drill hole casings along the drill hole. Such means are of particular significance in the case of deviated, that is, non-vertical, drilling, where placement of production tubing or drill hole linings under gravity cannot be relied upon.

The drill string can thus be provided with one or more external piston elements to be acted upon by a flow of drilling mud in the required direction along the space between the drill string and the drill hole wall. The piston elements can be selectively inflatable, as by means of fluid conveyed along the drill string where this has a structure as described above including one or more fluid passages besides the passage for drilling mud. Alternatively, the piston element can be a fixed configuration, with one or more passages containing check valves or selectively operable valves for permitting flow of the drilling mud during normal operation, the valves closing to render the piston element effective when the mud flow direction is reversed in order to advance the drill string.

Where production tubing or a casing for lining the drill hole wall is to be brought into position, the drill string can be clamped at its lower end to the drill hole wall, as by clamping means described below with particular reference to certain drill units embodying the invention, and the production tubing or the like can be moved by the action of drilling mud on one or more pistons extending inwardly from the tubing and sliding on the drill string, which can serve as a return path for the mud. After the placement operation has been completed, the drill string is unclamped and withdrawn.

The invention also provides a drilling system of the kind described having one or more electrically powered drive means for effecting movement of the drill string and/or production piping and/or drill hole casing along the drill hole. Such drive means can comprise a frame secured externally of the drill string and carrying electrically powered traction elements, for example, wheels, roller or drive belts, engageable with the drill hole wall. The drive means can instead comprise one or more electrical windings secured to the drill string so as to extend around it and to function when energized as an element of a linear electric motor, the other element of which is constituted by a drill hole casing. By suitable energization of the motor windings the drill string casing and the drill string can be relatively moved in either direction or rotationally.

This form of drive means in particular can be used also to assist or effect installation of the drill hole casing and/or of production piping after the drilling has been completed, with the leading end of the drill string clamped as described above in connection with the use of drilling mud to affect such placement. Both techniques can of course be used for movement relative to the drill string or other selectively campable core or guide member in either direction. Power can be supplied to these drive means by way of the conductors extending along a drill string in accordance with the invention as described above.

The invention also provides a drill unit for use in a drilling system of the kind described, the drill unit including a rotational or linear electric motor for applying a rotational and/or reciprocal drive to the drill bit directly or through a mechanical or hydraulic mechanism driven by the motor.

In a simple arrangement, the drill unit of the invention comprises a drill bit carried by a drill shaft rotatably driven by an electric motor which may be concentrically arranged around the drill shaft. The motor may be arranged to rotate the drill bit at a predetermined speed or the speed may be adjusted by a frequency control device. The motor can instead be coupled to the drill shaft not directly but by means of a speed/torque converter in the form of a gearbox, hydraulic coupling or hydrostatic transmission device or a combination of these.

The invention also provides a drill unit for use in a drilling system of the kind described, the unit having a percusive drill bit reciprocating by a linear electric motor. The linear electric motor can be arranged to drive the drill bit positively in both directions, but alternatively the motor can be arranged to effect movement in one direction only, movement in the other direction being effected by release of a spring which has been stressed during the electrically powered stroke.

The invention also provides a drill unit for use in a drilling system of the kind described in which a linear electric motor advances a plunger in an hydraulic system, the drill bit being reciprocated by the consequential movement of a piston within a hydraulic cylinder of the system. Again, both the operative and return stroke of the drill bit can be positively powered, or a spring loading means can be provided to power one of the strokes, as with the arrangement described above.

When the drill string extends generally vertically, its weight applies adequate axial loading to the drill bit, but the drill string cannot be used alone and with sufficient accuracy to apply such loading during horizontal drilling.

The invention accordingly provides a drill unit for use in a drilling system of the kind described which comprises a first portion carrying the drill bit, a second portion for connection to the drill string, and means for selectively advancing the first portion relative to the second portion.

The second portion can be provided with clamping means whereby it can be selectively clamped to the formation being drilled, that is, to the drill hole wall. The two drill unit portions are preferably telescopically related and are arranged to be relatively moved hydraulically. The drill string can be in accordance with the invention as described above and the fluid pressure can be applied by way of a fluid passage with which the drill string is provided, or can be generated locally, within the drill unit, as with fluid pressure used for operating the drill bit.

It is frequently of importance that the direction of drilling be controlled and the invention accordingly provides a drilling unit for use in a drilling system of the kind described having means for orientating the axis of the drill bit at a predetermined angle to the drill hole axis. The drill bit axis can be selectively adjustable relative to the drill unit axis or the drill unit itself can be adjustable relative to the drill hole or its casing, as by clamping means of the kind described above provided with selectively adjustable spacing between the drill unit and the drill hole and casing.

The invention also provides a drilling system of the kind described comprising means for clamping the drill string to the drill hole wall or to the drill hole casing at one or more appropriate positions, for example adjacent to the drill unit, so as to transfer the reaction force of the drilling from the drill string.

BRIEF DESCRIPTION OF THE DRAWINGS

The invention is further described below, by way of example, with reference to the accompanying drawings, in which.

Figure 1:
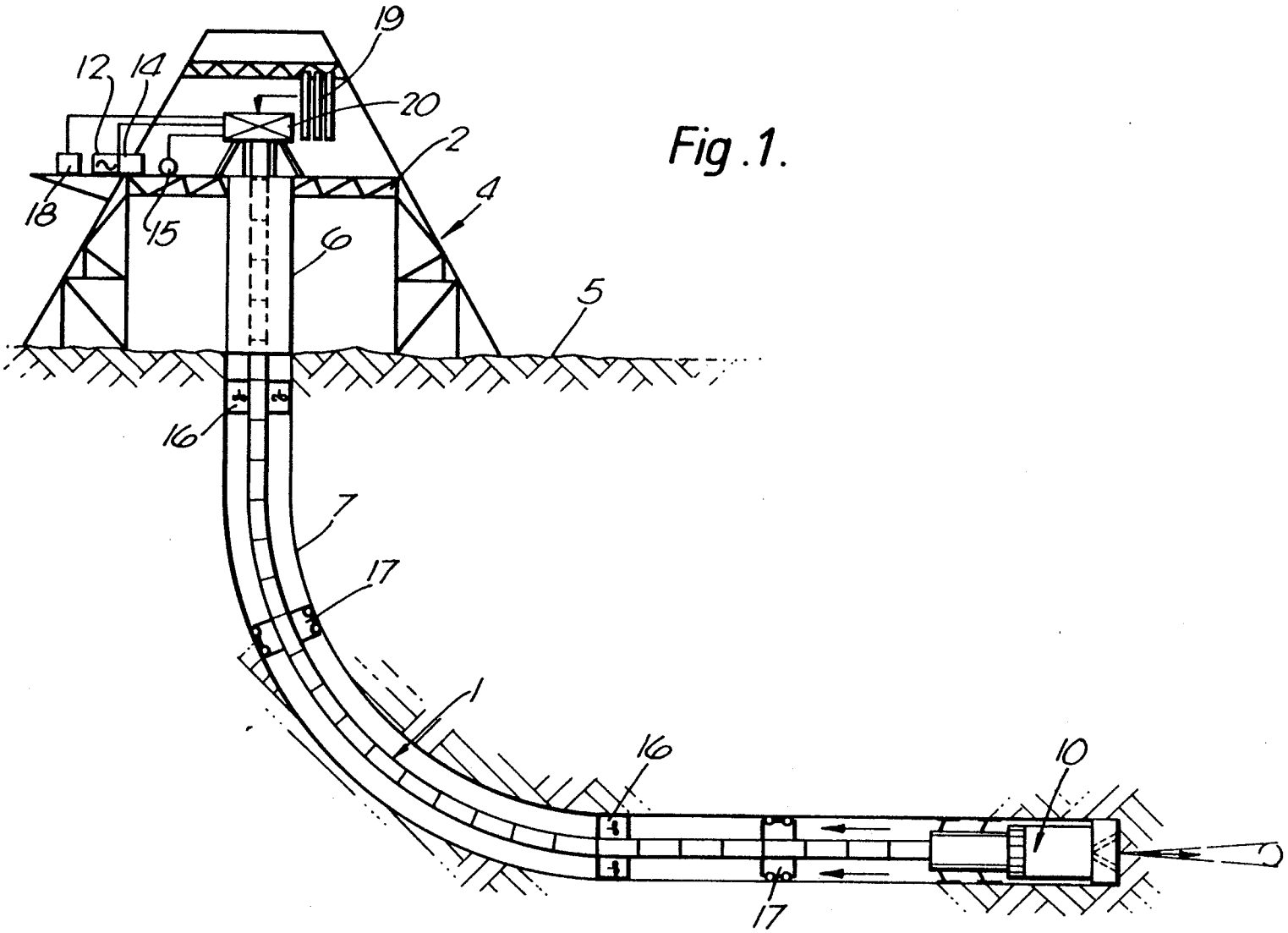
FIG. 1 is a schematic general view of an entire drilling system embodying the invention.

The drilling system schematically shown in FIG. 1 comprises a drill string 1 extending from topside control and supply equipment located on a platform 2 of a drilling frame or structure 4 resting on the seabed. The drill string 1 extends generally vertically downwardly from the platform 2 within tubing 6 into a drill hole 7 which curves from an upper vertical portion communicating with the tubing to a generally horizontal end portion in which a drill unit 10 at the end of the drill string is operating.

The drill string 1 incorporates electric conductors which can perform various functions. They can thus supply power to an electric motor in the drill unit 10 from a power supply unit 12 on the platform 2, the electric motor driving and/or advancing the drill bit either directly or by way of a hydraulic mechanism. Additionally, the conductors can be employed for communication between a system control unit 14 on the platform 2 and condition-sensing equipment and/or a local control unit for the drill unit 10. Multiplexing techniques can be employed to provide a plurality of communication channels on a single conductor, which can additionally supply power along the drill string 1. Drilling mud is circulated between a mud unit 15 on the platform 2 and the drill unit 10 by way of the drill string 1 and the generally annular passage between the drill string and the drill hole wall and pumping units 16 spaced along the drill string within the passage are powered by means of the conductors. Traction units 17 for advancing the drill string 1 along the drill hole are similarly powered and controlled.

The drill string 1 can also provide a fluid supply passage or fluid supply and return passages, for fluid communication between equipment 18 on the platform 2 and the drill unit 10 and/or other elements of the system. The fluid can perform a variety of functions, some in place of certain functions of the electrical arrangements described above. The drill string 1 is handled by pipe handling equipment 19 on the platform 2, and the drill string structure can be such that the equipment 19 is conventional.

The drill string 1 is suspended from the platform 2 by means of an adapter 20 for effecting the necessary connections between the equipment on the platform 2 and the various supply and communication channels of the drill string 1.

In the following more detailed description of various possible forms of certain elements of the system, parts which serve equivalent functions are given the same reference numerals throughout. It will be understood that certain features to be described can be combined in different ways, that is, certain features, for example of one of the drill units can be employed in one or more of the other drill units illustrated.

Turning now to the structure of the drill string 1, this is composed of sections of suitable length coupled together. Each section includes rigid electrical conductor means structurally integrated into the drill string section of which various forms are shown in FIGS. 2–6.

Figure 2:
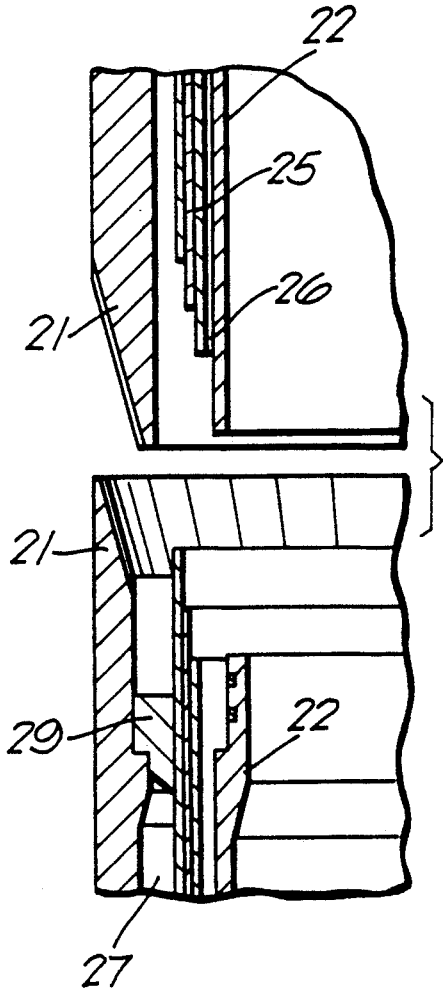
FIG. 2 is a partial sectional side view of a drill string which can be incorporated in the system of FIG. 1.

As shown in FIG. 2, the drill string 1 comprises a drill pipe 21 containing concentrically within it an inner pipe or mud liner 22, the interior of which guides the drilling mud to the drill unit, and conductor tubing 25 received between the mud liner and the drill pipe. The conductor tubing 25 comprises a plurality of concentric metal tubes, for example three such tubes for a 3-phase power supply, with sleeves of solid insulation material between them. A concentric tubular conductor assembly of this kind is described in EP-A-0 063 444, the contents of which are incorporated herein by reference. The conductor tubing 25 is spaced from both the drill pipe 21 and the mud liner 22 to define inner and outer annular passages 26,27 which can be employed as supply and return paths for fluid. The fluid has insulating properties where the conductor tube assembly is internally and externally free of insulation.

Suitable spacing means are provided to maintain the concentric relationship of the mud liner 22 the conductor assembly 25 and the drill pipe 21. For example, as shown in the lower part of FIG. 2, the conductor assembly 25 can be provided with externally projecting hangers 29 arranged to rest with suitable insulation, on an internal shoulder of the drill pipe.

Connection is made between the ends of adjacent sections of the drill pipe 21 in any suitable way, the lower end of the upper section being shown as provided with a downwardly and inwardly tapered end portion engageable with a mating tapered portion at the upper end of the lower section. The ends of the tubular conductors of the upper conductor tubing 25 are stepped back one from the other, and the conductors of the tubing in the lower section are stepped back in the contrary manner to provide for continuity of electrical connection and insulation between the two sections, in a way described in more detail in EP-A-0 063 444. The upper end of the mud liner 22 in the lower section has a stepped end portion for reception in the lower end of the liner of the upper section, with sealing rings operative between the two mud liner sections.

Figure 3:
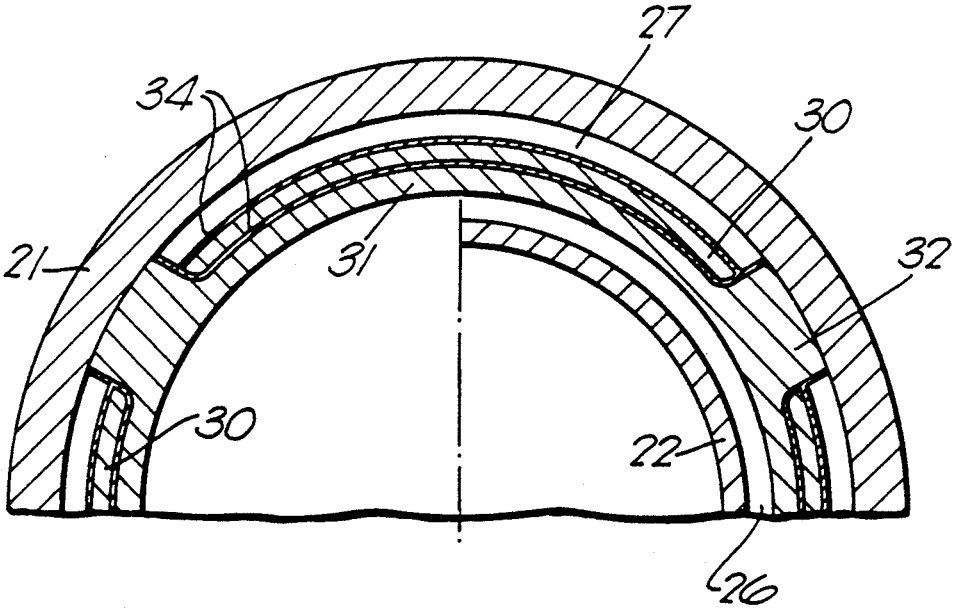
FIG. 3 is a partial cross-sectional view of a first modified form of the drill string of FIG. 2.

In the modified drillstring structure of FIG. 3, the conductor tubing is constituted as an assembly of separate arcuate portions or segments 30 of a tube, with insulation between them. The conductor segments 30 are held in position by an inner pipe 31 spaced outwardly of the mud liner 22 and provided with radially outwardly extending spacers 32 which engage the drill pipe 21. Insulation 34 is provided between each segment 30 and the inner pipe 31, and the insulation may extend also to the outer surface of the segment. Each segment 30 is spaced from the drill pipe to provide one of the supply and return passages 26,27 for a protective fluid, of which the other is formed between the inner pipe and the mud liner.

Figure 4:
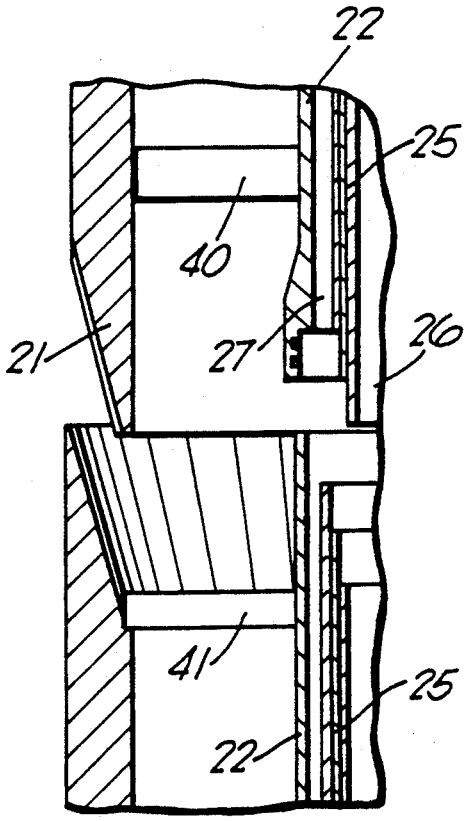
FIG. 4 is a partial sectional side view of a second modified form of the drill string of FIG. 2.

In the alternative conductor tubing arrangement shown in FIG. 4, the mud supply is by way of an annular passage between the drill pipe 21 and a protective pipe or mud liner 22 concentrically received therein and surrounding a tubular conductor 25 which corresponds generally to the tubular structure assembly of FIG. 2, but is of course of smaller diameter. The supply and return passages 26,27 for the protective fluid are in this arrangement within the conductor tubing 25 and between it and the mud lines 22 respectively. As shown, connection arrangements at the ends of adjacent drill pipe sections are similar to those provided for in the arrangement of FIG. 2. Suitable spacers 40 and hangers 41 extend between the mud liner 22 and the drill pipe 21 to maintain the mud liner and conductor tubing in correct concentric relationship within the drill pipe.

Figure 5:
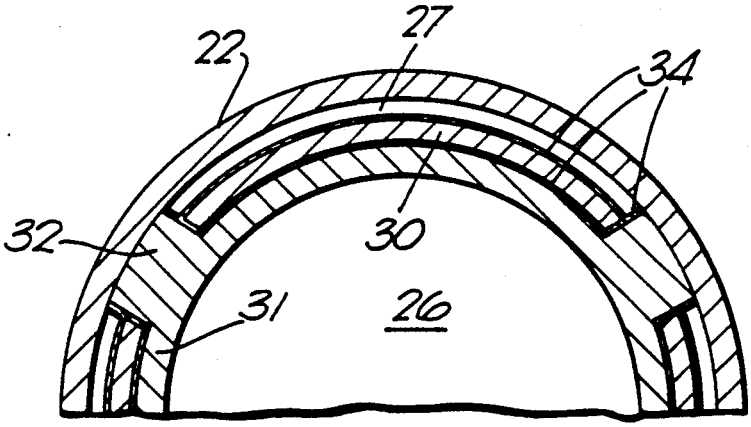
FIG. 5 is a partial cross-sectional view of a conductor assembly only, of a third modified form of the drill string FIG. 2.
Figure 6:
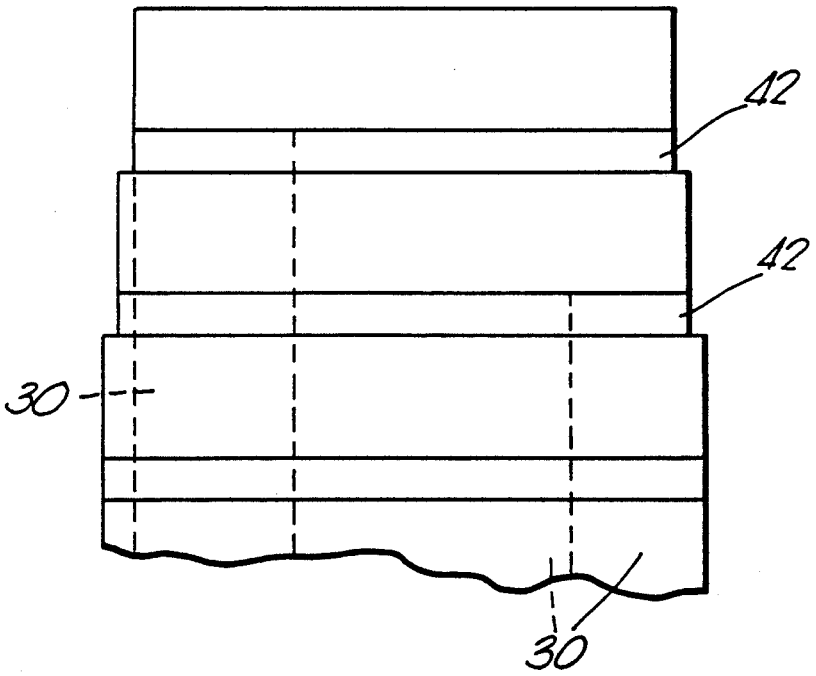
FIG. 6 is a schematic side view of a connector plug for the conductor assembly of FIG. 5.

In accordance with FIG. 5, the conductor tubing arrangement of FIG. 4 can be modified to include segmental conductors 30 similar to those of FIG. 3. Thus for example three segmental conductors 30, with insulation 34, surround an inner pipe 31 from which radial spacers 32 extend to the mud liner 22. The conductor segments 30 are spaced from the mud liner to define the outer passage 27 for protective fluid, and the interior of the inner pipe delines the inner passage 26.

Where segmental conductors are employed, as shown in FIGS. 3 and 5, and the drillstring sections are connected together by screw-threaded connections at their ends, so that the relative angular location is not predetermined, electrical continuity between respective segments 30 can be achieved by the coupling arrangement shown in FIG. 6. Here, each of the conductor segments at the end of a drillstring section is in electrical connection with a respective end contact ring 42. The end rings 42 are of successively larger diameter contact downwardly from the free end of the section to form a male coupling assembly. The co-operating female assembly (not shown) is formed as a socket with internal steps matching in diameter and axial spacing the external steps of the male assembly illustrated. At these steps, respective conductor segment ends are exposed, so that they can engage the contact rings of the male coupling assembly.

In any of the arrangements of FIGS. 2–6, one of the protective fluid passages can be omitted where the fluid is to be leaked into the drilling mud at the drill unit so that no return path is required. For example, as shown on the lefthand side of FIG. 3, the mud liner 22 can simply be omitted, so that its function is performed by the inner pipe 31.

The drill string 1 needs to be advanced along the drill hole 7 as drilling progresses and FIGS. 7, 8, 9 and 10 show different forms of drive means for achieving this advance, or for withdrawal of the drill string if required.

Figure 7:
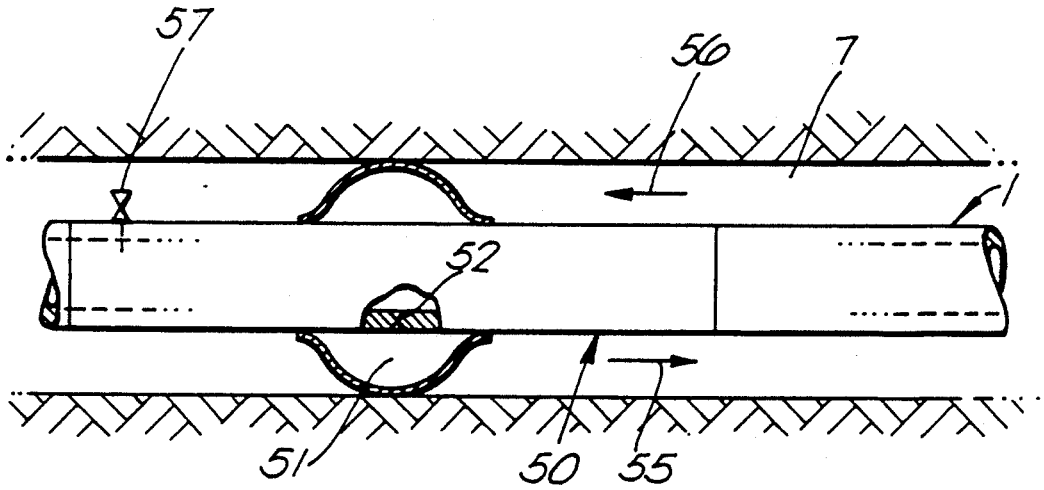
FIG. 7 schematically illustrates a first traction unit for moving a drill string along a drill hole in accordance with the invention.

As appears from FIG. 7, the drill string 1 includes a section 50 of which the interior can correspond to any one of the drill string sections described in connection with FIGS. 2–6 but which carries externally an inflatable packer 51 which can be selectively inflatable, as by admission to its interior of the protective fluid conveyed along the drill string by way of an electrically controlled valve 52. When inflated, the inflatable packer 51 functions as a piston whereby the drill string 1 is moved along the drill hole by the pressure of drilling mud between the drill string and the wall of the drill hole 7 which acts as an hydraulic fluid. Drilling mud is normally circulated to the drilling unit 10 inside the drill string and returned between it and the drill hole wall, as indicated by the arrow 55, so that the inflatable packer would thus be urged to retract the drill string rather than advance it. To obtain the desired drill string advance, the direction of the mud flow is reversed to that indicated by the arrow 56.

The pressure on the near side of the inflated inflatable packer 51 must of course exceed that on the far side and an electrically controllable mud dump valve 57 can be provided in the wall of the drill string downstream of the inflatable packer, so that drilling mud pressure on the far side of the annulus is reduced by passage of mud on that side to the mud flowing within the drill string. When the inflatable packer 51 is deflated mud circulation in the usual direction can continue unobstructed.

Figure 8:
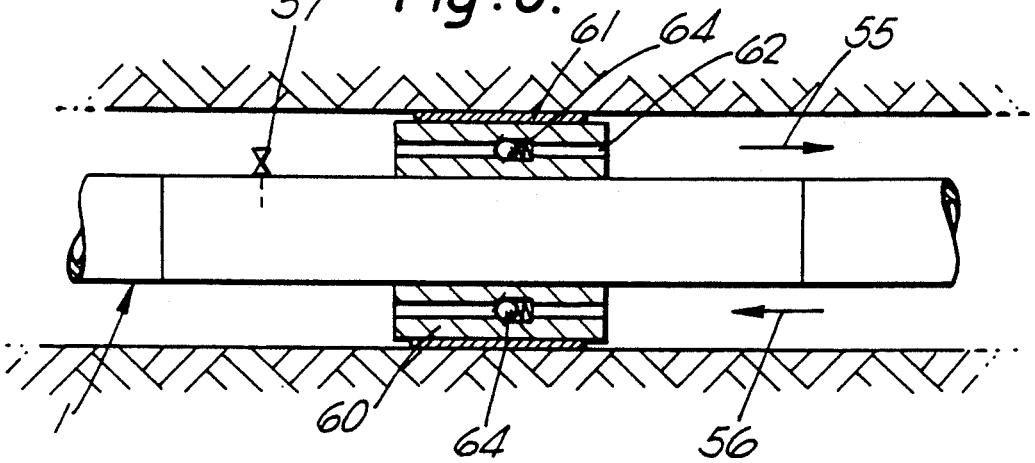
FIGS. 8, 9 and 10 schematically show respectively a second, third, and a fourth means in accordance with the invention for moving a drill string along a drill hole.

The traction unit shown in FIG. 8 also employs the drilling mud as a hydraulic fluid, but instead of an inflatable annulus, the mud engages a piston element 60 of fixed form secured externally around a section of the drill string 1. The piston element 60 is sealed to the wall of the drill hole by annular flexible sealing members 61 which extend radially outwardly to the wall so that the pressure of drilling mud during traction enhances the seal. A plurality of passages 62 extend through the piston element 60 and each includes a non-return valve 64 which permits mud flow through the associated passage in the direction of the arrow 55 during drilling. When the drill string 1 is to be advanced, the direction of mud flow is reversed, so that the mud flows in the annular space between the drill string and the drill hole wall in the direction indicated by the arrow 56. The non-return valves 64 close the passages 62 through the piston element rendering this effective to achieve the desired drill string movement.

The non-return valve 64 can instead be a selectively operable valve controlled directly, by electrical means, or indirectly, as by electrohydraulic means, so that it can function as a deep set blow out preventer valve, when it is desired to close off the drill hole other than by the use of an X-mas tree valving arrangement.

Figure 9:
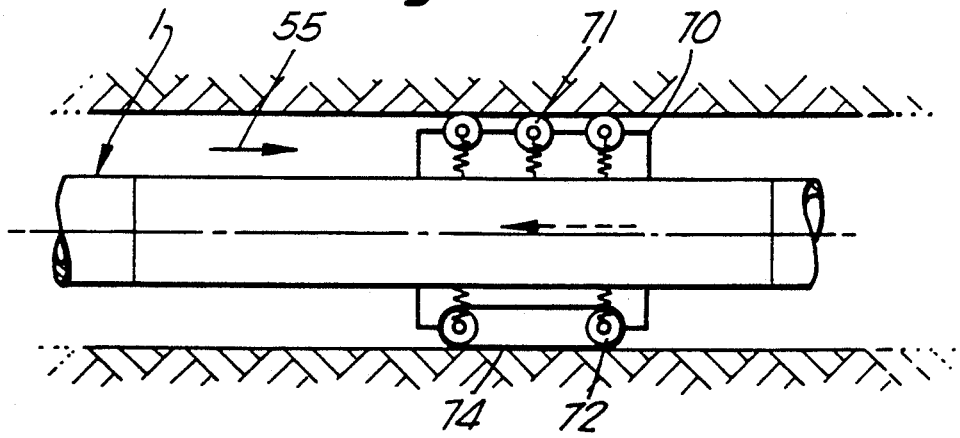

The traction unit shown in FIG. 9 comprises a frame 70 permanently secured to the exterior of a drill string section, the frame being such as not to unduly obstruct the flow of mud between the drill string and the drill hole wall. The frame 70 rotatably mounts traction elements in the form of wheels or rollers 71 which may be spring urged to engage the wall, and are electrically driven so as to advance the drill string 1 as and when required. In an alternative arrangement, shown at the lower part of FIG. 9, the frame 70 mounts rollers 72 around which is entrained a traction belt 74 engageable with the drill hole wall, the rollers again being selectively driven by an electric motor taking its power from the conductors within the drill string.

Figure 10:
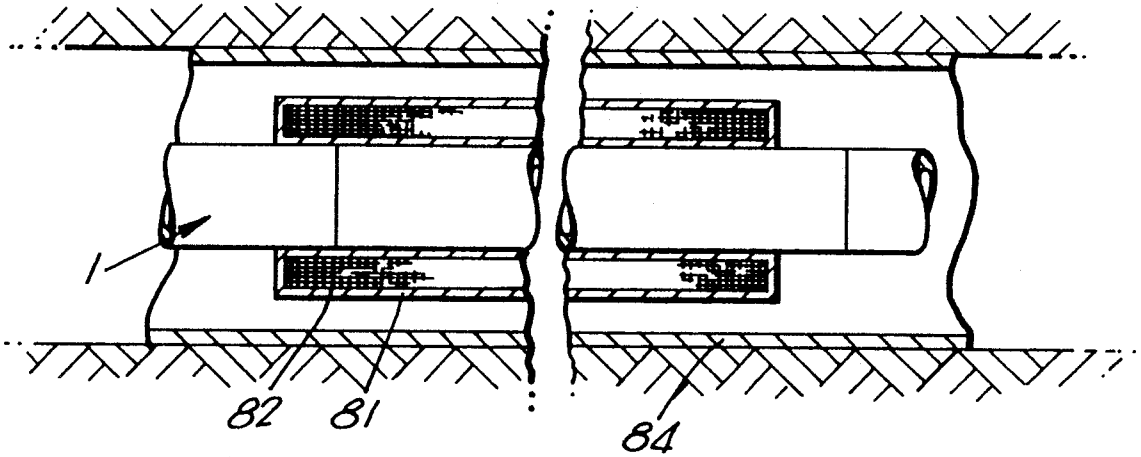

The traction unit illustrated in FIG. 10 is also electrically driven and comprises an annular casing 81, which contains an electrical winding 82 and which is fixed to and surrounds the drill string 1, or is incorporated in the drill string as a separate drill string section. The winding 82 can be selectively energized by way of the conductors within the drill string so as to function as a component or "stator" of a linear electric motor, the other component or "rotor" being represented by a steel casing 84 lining the drill hole. By suitable control of the energization of the winding 82 the drill string 1 can be moved along the casing 84 in either direction, as desired.

It will be evident that the various means described above for advancing or withdrawing the drill string 1 can be employed for moving the casing 84, or other external piping, for example, production tubing, along the drill hole in either direction. Such movement can be effected relative to a core or guide member in place of the drill string. The member or drill string requires to be held stationary, and its leading end may be selectively clamped to the drill hole wall by clamping means as described below.

Figure 11:
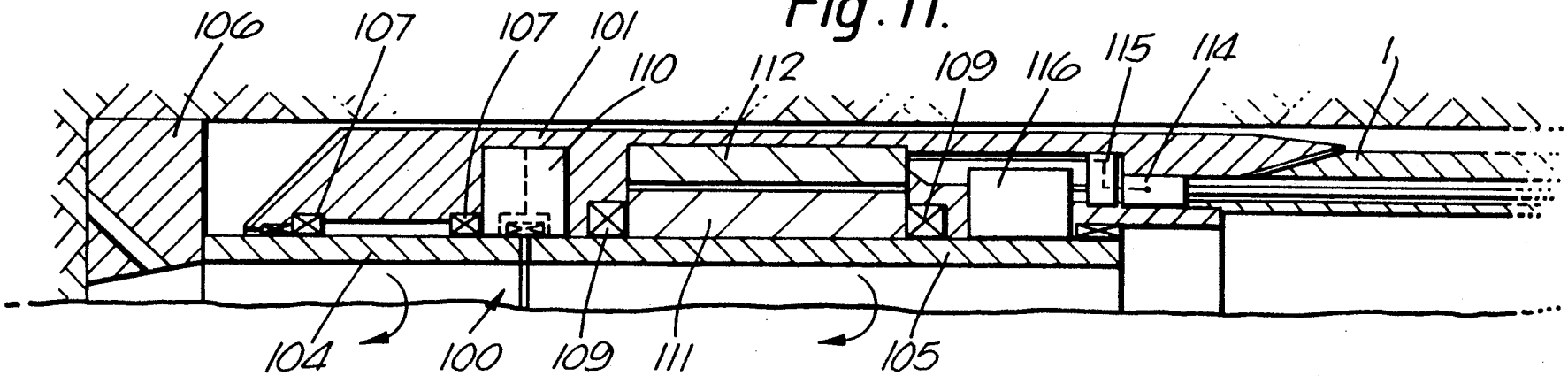
FIG. 11 is a partial sectional side view of a first drill unit which can be incorporated in the system of FIG. 1.

The drill unit 100 of FIG. 11 comprises a cylindrical housing 101 having a rotatable drill shaft formed of aligned forward and rear portions 104, 105 concentrically received therein. The drill shaft is hollow to provide a passage for the supply of drilling mud to a drill bit 106 carried by the shaft portion 104, which is journalled in bearings 107. The rear shaft portion 105 is jounralled in bearing 109 and is connected to the forward portion by way of a selectively adjustable speed/-torque converter 110.

Between the bearings 109, the rear shaft portion 105 carries an annular rotor portion 111 of an electric motor which is concentrically surrounded by an annular stator portion 112 secured to the housing 101. The housing 101 is connected at its rear end to a drill string which has one of the forms shown in FIGS. 2–6, with conductor tubing extending to a connector box 114 connected to a distributor unit 115. The conductor tubing of the drill string 1 provides not only power for the electric motor 111,112 but also data communication between the control equipment 14 located on the platform 2 and a local control unit 117, for control of the electric motor, and also between the control equipment and sensor means 116 for monitoring motor operation and progress of the drilling.

The speed/torque converter 110 may be omitted where direct drive of the drill bit 106 by the electric motor 111,112 is satisfactory.

Instead of a rotary drill bit, the drill unit of the invention can mount a reciprocable drill bit which operates percusively. In the drill unit 120 of FIG. 12, the housing 121 has a hollow drill shaft 122 concentrically guided therein for reciprocating movement by slide bearings 124. At its forward end, the housing 121 includes the stator 125 of a linear electric motor, of which the drill shaft 122 functions as the "rotor". The housing 121 connects at its rearward end to a drill string 1 which can again be one of the kinds described with reference to FIGS. 2–6.

The linear electric motor constituted by the stator 125 and the drill shaft 122, can be operated so as to power both the forward and return strokes of the drill bit 106 by appropriate change of the phase sequence of the electrical supply, or alternatively, the motor could operate to effect only one of the strokes, for example the return stroke, the other stroke being then effected by release of energy stored during the powered stroke. The unit 120 can thus incorporate a plurality of compression springs 126 extending into respective bores opening from the rear end of the drill shaft 122, the outer ends of the springs being held by retaining members 127 secured to the housing 121, which contains also a local control system 116.

To better support the unit 120 against the cutting stroke of the drill bit, the housing 121 can be provided with clamping devices 129 engageable with the drill hole wall, whereby the housing is concentrically clamped within the drill hole. Such clamping devices can be provided additionally or instead on the drill string 1 at suitable positions, to transfer the drilling reaction forces experienced by the drill string, so as to resist any tendency for the drill string to buckle. The clamping devices 129 can be of the kind described below with reference to FIG. 12.

Figure 12:
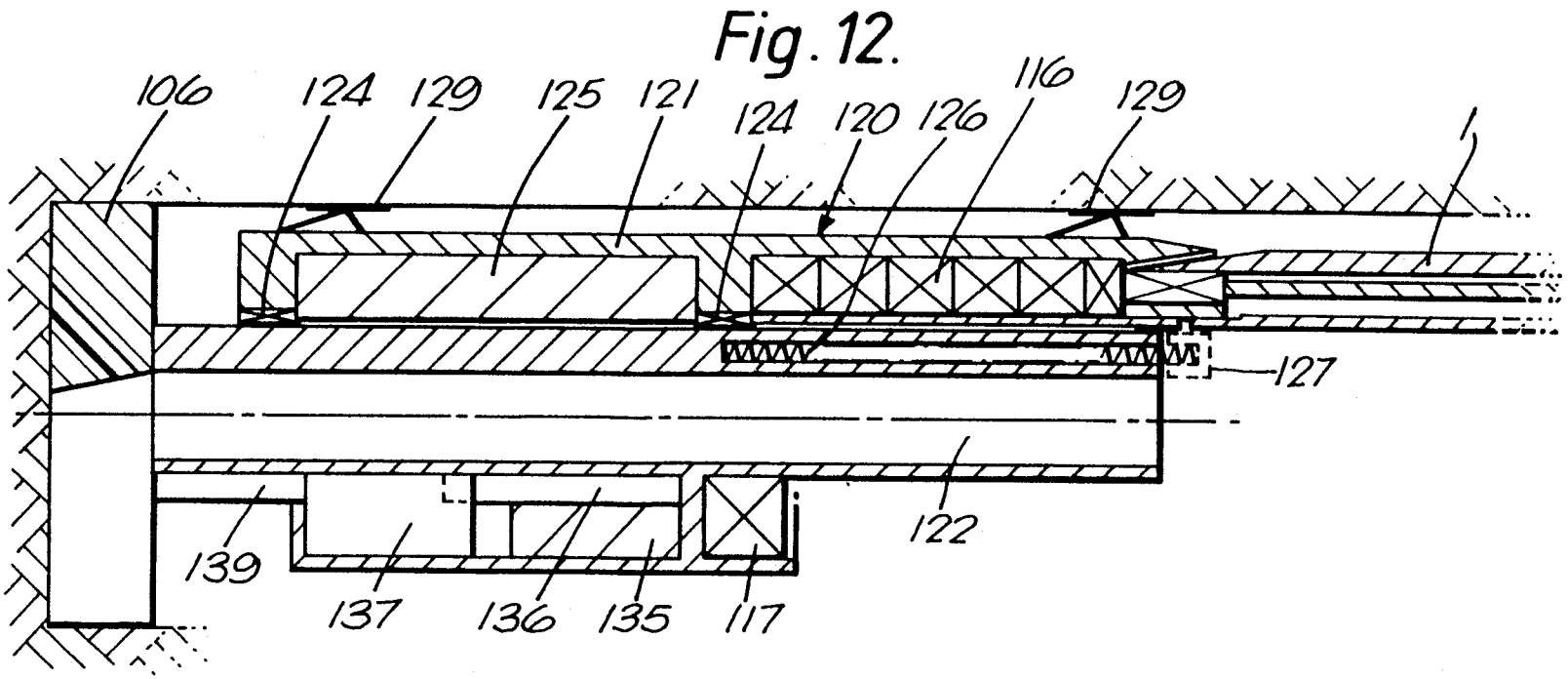
FIGS. 12–15 are like views of second, third, fourth and fifth alternative drill units for use in the system of FIG. 1 respectively.

In a modification of the drill unit 120, schematically shown at the lower part of FIG. 12, the linear motor stator 135 operates a plunger 136 of a hydraulic system 137 to move a piston within a hydraulic cylinder of which the piston rod 139 carries the drill bit 106.

Figure 13:
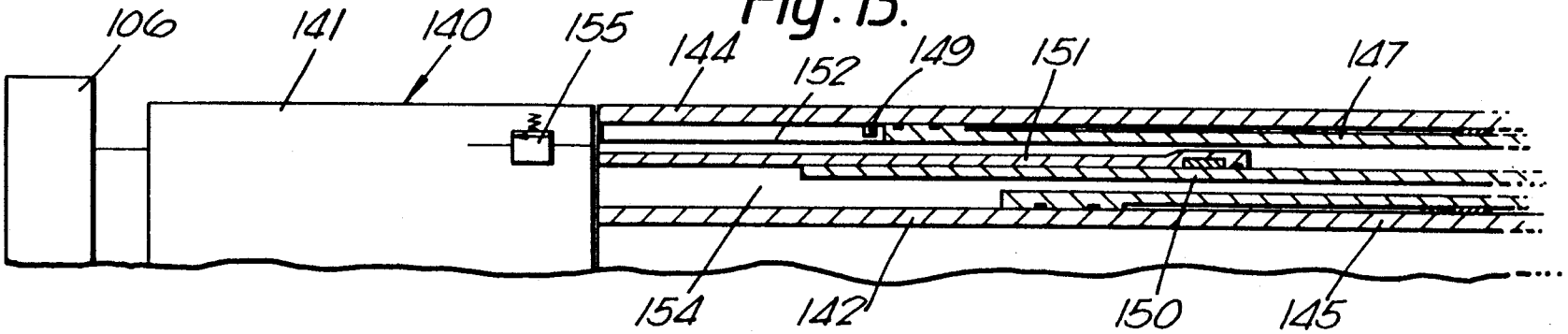

In the drill unit 140 of FIG. 13, the drill bit 106 and the motor for driving it are arranged for axial movement relative to a "stationary" portion of the unit connected to the drill string or constituted by the end thereof.

As shown, the drill bit 106 extends forwardly from a casing 141 containing a motor by which the drill bit is driven. Concentric inner and outer sleeves 142,144 extending rearwardly from the casing 141. The inner sleeve 142 serves for the conveyance of drilling mud to the drill bit and is sealed to an inner sleeve 145 of the stationary portion of the unit within which it slides. The stationary portion of the unit also has an outer sleeve 147 slidably received within the sleeve 144 and sealed thereto. A pin 149 on the sleeve 144 slides in a longitudinal slot of the sleeve 14 to prevent relative rotation of the two portions of the unit.

Between the two sets of inner and outer sleeves, sliding electric contacts or other means, for example flexible cables, are provided for transmission of electric power and/or communication signals. The stationary portion of the unit is thus provided with tubing 150 supporting a plurality of segmental conductors, suitably of the kind described in connection with FIGS. 3 and 5, which are in sliding contact relationship with corresponding conductor tubing 151 extending rearwardly from the casing 141.

Fluid pressure conveyed along the drillstring 1 to the space 152 between the outer sleeve 144 and the conductor tubing 151 acts on the casing 141 to apply axial loading to the drill bit. The annular space 154 within the conductor tubing provides a low pressure fluid return path, and the high pressure and low pressure fluid spaces are connected together through a pressure control valve 155 within the casing 141, the valve being adjustable so that the loading of the drill bit is in accordance with requirements.

The relatively sliding surfaces of the stationary and movable portions of the drill unit 140 are provided with stops which limit the relative movement corresponding to a certain advance of the drill bit. At this point, the drillstring 1 is advanced in the drill hole, as by the means described with reference to FIGS. 7–10, relative to the new stationary drill bit 106 and casing 141. Thereafter, drilling is recommenced under the axial drill bit loading applied by the fluid pressure.

Figure 14:
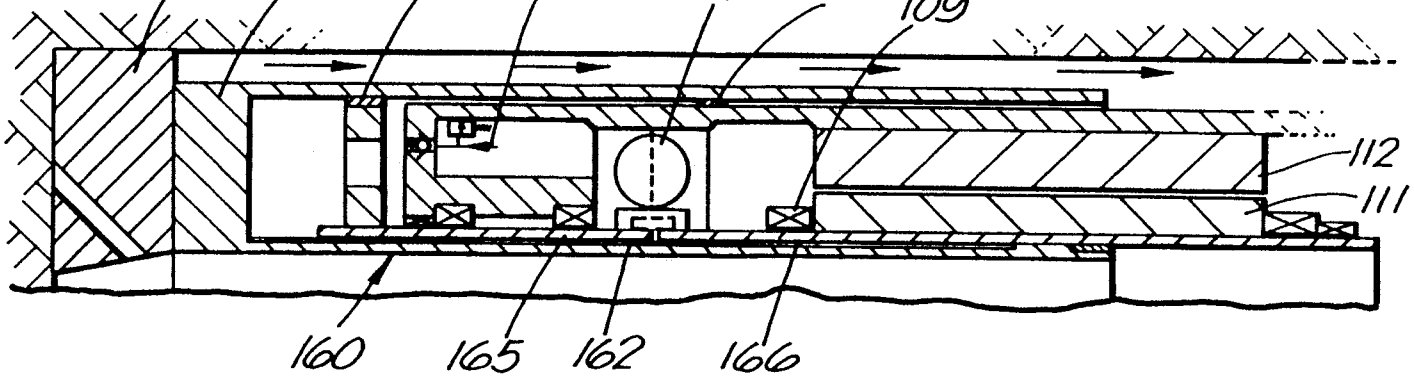

The drill unit 160 shown in FIG. 14 is also telescopically constructed, so that the drill bit can be axially loaded under hydraulic pressure. The drill bit 106 is carried by a movable portion of the unit comprising a drill bit support 160 with rearwardly extending inner and outer concentric sleeves 162,164, of which the inner sleeve 162 serves to guide drilling mud to the drill bit. The "stationary" drilling unit portion is received between these two sleeves.

The inner sleeve 162 adjacent the support 161 is surrounded by a hollow drive shaft 165, which is splined to the inner sleeve so as to rotate therewith. Rearwardly from the shaft 165, a hollow motor shaft 166 also surrounds and is sealed to the inner sleeve 162 but is capable of rotation with respect to it. The motor shaft 166 is driven by an electric motor of the same form as the motor employed in the drilling unit 100 and drives the drive shaft 164 by means of a torque converter or speed reducer 110 of the kind employed in the drilling unit 100.

The inner surface of the drill bit support 160 and adjacent surfaces of the inner and outer sleeves 162,164 provides a pressure chamber, sealed from the motor by sealing means 169, for fluid pressure conveyed along the drillstring 1, whereby the drill bit is subjected to axial loading adjustable by control means 155 as with the unit 140 of FIG. 13. The use and operation of the drilling unit 160 will be understood to be generally similar to that of the unit 140.

The fluid pressure axially loading the drill bit in the drill units of FIGS. 13 and 14 reacts against the stationary portions of the units and thus against the drill string to which they are attached. The stationary portions can however be clamped to the formation, by means of selectively actuable clamping devices 129 similar to those provided for the drilling unit 120.

Figure 15:
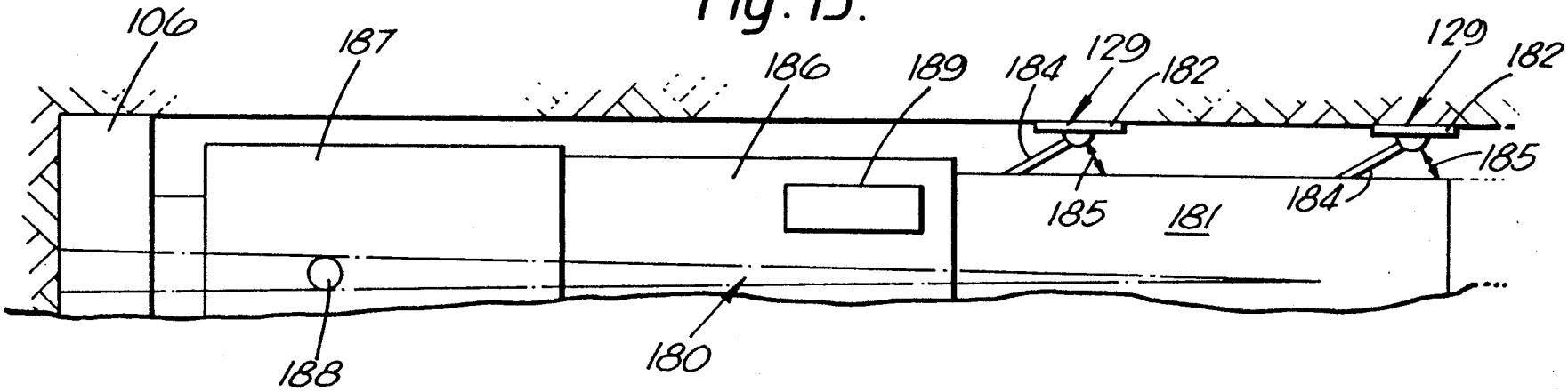

A drilling unit 180 shown in FIG. 15 thus comprises a stationary portion 181 provided with clamping devices comprising pads 182 pivotably carried at the outer ends of levers 184 pivoted to the outer wall of the stationary portion so as to extend outwardly and rearwardly of the drilling direction. Selectively operable actuator devices 185, for example hydraulic cylinders, act between the outer ends of the levers 184 and the stationary portion wall to urge the pads 182 against the drill hole wall or to withdraw them inwardly.

An axial loading portion 186 of the drilling unit extends forwardly in the drilling direction from the portion 181 and a motor unit 187 having the drill bit 106 at its forward end can be advanced in the drilling direction under hydraulic pressure developed in the loading portion.

The clamping devices 181,182 are preferably independently controllable, so that the drill bit axis can be orientated at a desired angle to the drill hole axis within an angular range, as indicated by the circle 188. Thus, in operation of the drill unit 180, the clamping devices 129 are released at the conclusion of a drilling stage to effect withdrawal of the pads 182 from the drill hole wall, and the drill string and stationary drilling unit portions are then advanced relative to the drill bit and motor unit 187, so that the drilling unit takes up a contracted condition. In accordance with command signals designating a desired drilling direction, or a direction indicated by information obtained by appropriate sensors associated with the drilling unit, the clamping devices 129 are actuated to apply a directional influence to the unit whereby a new drilling direction is determined. Drilling is then recommenced, with axial loading applied to the drill bit 106 so that this and the motor unit 187 advance relative to the stationary portion 181.

In the drill unit 180, and in the other drill units in which pressure fluid is used to load the drill bit, the fluid pressure can be generated within the unit, as by a motor driven pump unit 189. The pressure fluid from this source can be applied also to operation of the actuators 184. A power distributor or a power generator such as the unit 189 can be located at any appropriate position or positions along the drill string 1, and in the drill unit, wherever power is required for a specific operation, for example to activate local control mechanisms or sensing or measuring equipment. Such local power generators can be controlled remotely as by electrical control signals from the control equipment 14 and can themselves be powered electrically or from pressure fluid or the flow of drilling mud.

Although the functions of the various drill units described with references to FIGS. 11–15 can be controlled from the platform 2, provision can be made for a degree of local control at the drilling unit itself in response to locally sensed conditions. Also, if the hydraulic pressure required for axial drill bit loading and/or for clamp operation is generated locally, within the drill unit, the pressure fluid source can be controlled from the equipment on the platform 2 or in response to locally sensed conditions.

Although the invention has been described with reference to fixed offshore platform it will be evident that it can be employed also with floating drilling rigs or vessels and onshore drilling installations.

It is evident that those skilled in the art may make numerous modifications of the specific embodiment described above without departing from the present inventive concepts. It is accordingly intended that the invention shall be construed as embracing each and every novel feature and novel combination of features present in or possessed by the apparatus herein described and that the foregoing disclosure shall be read as illustrative and not as limiting except to the extent set forth in the claims appended hereto.

I claim:

1. A drilling system comprising topside equipment, a drilling unit, and a drill string extending between said topside equipment and said drilling unit, wherein said drill string comprises:

a drill pipe, a mud pipe concentrically received within said drill pipe and defining a mud passage for supply of drilling mud from said topside equipment to said drilling unit, electrical conductor means providing electrical communication between said topside equipment and said drilling unit and comprising three concentric angularly spaced arcuate conductors of equal radii, said mud pipe being received within said conductors, an inner pipe received concentrically between said mud pipe and said arcuate conductors, spacer portions on said inner pipe extending radially outwardly between said arcuate conductors to engage said drill pipe, and wherein a first and a second fluid passage each extending between said topside equipment and said drilling unit are provided between said mud pipe and said inner pipe and between said conductors and said drill pipe respectively.

2. The drilling system of claim 1 further comprising electrically insulating material around each of said arcuate conductors.

3. A drilling system comprising topside equipment, a drilling unit and a drill string extending between said topside equipment and said drilling unit, wherein said drill string comprises:

a drill pipe, a mud pipe concentrically received within said drill pipe and defining a mud passage for supply of drilling mud from said topside equipment to said drilling unit, electrical conductor means providing electrical communication between said topside equipment and said drilling unit and comprising three concentric angularly spaced arcuate conductors of equal radii received within said mud pipe, an inner pipe received concentrically in said mud pipe and said arcuate conductors, three spacer portions on said inner pipe extending radially outwardly between said arcuate conductors to engage said mud pipe, and wherein a first and a second fluid passage extending between said topside equipment and said drilling unit are provided between said conductors and said mud pipe and within said inner pipe respectively.

4. The drilling system of claim 3 further comprising insulating material around each of said arcuate conductors.

5. In a drilling system comprising a drill pipe extending between topside equipment and a drilling unit, electrical conductor means extending within said drill pipe comprising:

three arcuate electrical conductors of equal radii, an outer pipe concentrically received within said drill pipe, an inner pipe received within said outer pipe for conveyance of drilling mud to said drilling unit, said inner and outer pipes being spaced to provide therebetween a further passage for fluid communication between said topside equipment and said drilling unit, three angularly spaced spacer means extending between said outer pipe and said drill pipe, a respective one of said arcuate conductors being received between each adjacent pair of said spacer means with spacing to define fluid passage means for fluid communication between said topside equipment and said drilling unit.

6. A drill pipe assembly for use in a drilling system, the assembly comprising:

a drill pipe, an intermediate pipe concentrically received within said drill pipe with spacing to define a first conduit of annular cross-section therebetween, an inner pipe concentrically received within said intermediate pipe with spacing to define a second conduit of annular cross-section therebetween, a plurality of spacers extending radially between said intermediate pipe and one of said drill pipe and said inner pipe to divide one of said first and second conduits into a plurality of arcuate conduit portions of generally arcuate cross-section, and a plurality of electrical conductor means of generally arcuate cross-section, each of said electrical conductor means being located within a respective one of said arcuate conduit portions.

7. The drill pipe assembly of claim 6 wherein said spacers extend radially between said intermediate pipe and said drill pipe, and wherein each of said conductor means occupies part only of the arcuate conduit portion in which the conductor means is located.

8. The drill pipe assembly of claim 7 wherein said spacers are integrally formed portions of said intermediate pipe.

9. The drill pipe assembly of claim 6 wherein said spacers are three in number and are equiangularly distributed around said intermediate pipe.

10. The drill pipe assembly of claim 7 wherein each of said generally arcuate conductor means engages the outer surface of said intermediate pipe and the spacers defining the arcuate conduit portion within which said conductor means is located.

11. In a drilling system including topside equipment, and a drilling unit;

a drill string comprising the drill pipe assembly of claim 7 extending between said topside equipment and said drilling unit, means supplying drilling mud to said drill unit through the interior of said inner pipe, means effecting electrical communication between said topside equipment and said drilling unit by way of said plurality of electrical conductor means, and means for supplying fluid from said topside equipment along at least one of said first and second conduits.

12. The drill pipe assembly of claim 6 wherein said spacers extend radially between said intermediate pipe and said inner pipe and wherein each of said conductor means occupies part only of the arcuate conduit portion in which the conductor means is located.

13. The drill pipe assembly of claim 12 wherein said plurality of conductor means forms a ring of conductor means, the conductor means of said ring being separated only by said spacers.

14. The drill pipe assembly of claim 12 wherein each of said generally arcuate conductor means has an inner curved surface engaging said inner pipe and an outer curved surface spaced from said intermediate pipe.

15. In a drilling system including topside equipment and a drilling unit;

a drill string comprising the drill pipe assembly of claim 12 extending between said topside equipment and said drilling unit, means supplying drilling mud to said drill unit by way of said first conduit, means effecting electrical communication between said topside equipment and said drilling unit by way of said plurality of electrical conductor means, and means for supplying fluid from said topside equipment along at least one of said second conduit and the interior of said inner pipe.

16. In a drilling apparatus including topside equipment and a drill unit;

a drill string extending between said topside equipment and said drill comprising the drill pipe assembly of claim 6;

at least one remotely controllable power generating unit in at least one of said drill unit and said drill pipe, said power generating unit generating power for effecting at least one of local control and local sensor operations.

17. A drilling system comprising a drill string extending between topside and downhole equipment, said drill string comprising:

plural concentric pipes spaced to provide at least one annular passage, spacers extending radially of said pipes to divide said annular passage into arcuate passage portions, plural electrical conductor means each of arcuate cross-section, the conductor means being concentrically located each in a respective one of said arcuate passage portions with radial spacing from one of said concentric pipes to provide fluid conduits within said passage portions.

18. The drilling system of claim 17 wherein each of said conductor means has an arcuate extent substantially equal to that of the said arcuate passage portion in which it is located.

19. The drilling system of claim 17 wherein said conductor means are three in number and are uniformly spaced around said drill string.

20. The drilling system of claim 17 wherein each of said conductor means engages one of the said concentric pipes and extends between said spacers defining said passage portion within which the conductor means is located.

21. The drilling system of claim 17 further comprising, at at least one position along said drill string, a drive unit selectively operable to move said drill string within a drill hole in response to power supplied and/or control signals transmitted by the conductor means.

22. The drilling system of claim 21 wherein said drive means comprises at least one piston element carried externally by said drill string and selectively responsive to the flow of fluid within the system to effect said movement.

23. The drilling system of claim 22, wherein said fluid comprises drilling mud.

24. A drilling system comprising topside equipment, a drill unit, and a drill string extending from said topside equipment to said drill unit, wherein:

said drill string comprising:

a drill pipe, a mud pipe, a tubular conductor assembly, said conductor assembly comprising a plurality of conductor elements each having the form of at least part of a tube; and each of said drill pipe, said mud pipe and said plurality of conductor elements extending from said topside equipment to said drill unit, means mounting said mud pipe and said conductor assembly substantially concentrically within and spaced from said drill pipe, and spaced apart from each other, thereby to provide within said drill pipe a mud passage for supply of drilling mud from said topside equipment to said drill unit, and a first and a second fluid passage each providing fluid communication between said topside equipment and said drill unit, said first and said second fluid passages being at least in part defined by said conductor assembly, said drill unit comprising:

a drill bit, an electric motor for driving said drill bit, said electric conductor elements being connected to said electric motor for supplying power thereto from said topside equipment, and fluid passage means extending through said electric motor and communicating with said first and said second fluid passages, said topside equipment comprising:

means for supplying drilling mud through said mud passage to said drill unit, and means for circulating fluid downwardly through one of said first and second fluid passages to said drill unit, through said fluid passage means, and upwardly from said drill unit to said topside equipment through the other of said first and second passages.

25. The drilling system of claim 24, wherein said conductor elements comprise tubular conductor elements and said conductor assembly further comprises solid insulation between said tubular conductor elements.

26. The drilling system of claim 24, wherein said conductor elements comprise part-tubular conductor elements of equal radii centered on a common axis, and said conductor assembly further comprises a support ring having radially projecting spacer means, a respective on of said conductor elements being received between each adjacent pair of said spacer means.

* * * * *